US007665537B2

(12) United States Patent
Patel et al.

(10) Patent No.: US 7,665,537 B2
(45) Date of Patent: Feb. 23, 2010

(54) SYSTEM AND METHOD TO SEAL USING A SWELLABLE MATERIAL

(75) Inventors: Dinesh R. Patel, Sugar Land, TX (US); Y. Gil Hilsman, III, Friendswood, TX (US); Herve Ohmer, Houston, TX (US); Stephane Hiron, Houston, TX (US); Philippe Gambier, Houston, TX (US); Jonathan K. C. Whitehead, Missouri City, TX (US); Randolph J. Sheffield, Sugar Land, TX (US); Rodney J. Wetzel, Katy, TX (US); John R. Whitsitt, Houston, TX (US); Thomas D. MacDougall, Sugar Land, TX (US); Nitin Y. Vaidya, Sugar Land, TX (US); James D. Hendrickson, Sugar Land, TX (US); John E. Edwards, Sultanate of Oman (OM); Donald W. Ross, Houston, TX (US); Rashmi B. Bhavsar, Houston, TX (US)

(73) Assignee: Schlumbeger Technology Corporation, Sugar Land, TX (US)

( * ) Notice: Subject to any disclaimer, the term of this patent is extended or adjusted under 35 U.S.C. 154(b) by 703 days.

(21) Appl. No.: 10/906,880

(22) Filed: Mar. 10, 2005

(65) Prior Publication Data

US 2005/0199401 A1 Sep. 15, 2005

Related U.S. Application Data

(60) Provisional application No. 60/521,427, filed on Apr. 23, 2004, provisional application No. 60/552,567, filed on Mar. 12, 2004.

(51) Int. Cl.
*E21B 33/10* (2006.01)
*E21B 33/13* (2006.01)

(52) U.S. Cl. ..... 166/387; 166/187; 166/191; 166/285

(58) Field of Classification Search ..... 166/179, 166/187, 191, 387, 285
See application file for complete search history.

(56) References Cited

U.S. PATENT DOCUMENTS 2,945,451 A 7/1960 Griswold
2,945,541 A * 7/1960 Maly et al. ..... 166/185

(Continued)

FOREIGN PATENT DOCUMENTS

GB 2388136 A 11/2003

(Continued)

(Continued)

OTHER PUBLICATIONS

Al-Anazi, Hamoud A., Sharma, Mukul M.; Evaluation of a pH-Sensitive Polymer for Gravel-Packing Operations; SPE Production and Operations Symposium; Oklahoma City, OK; Mar. 24-27, 2001; SPE 67292; Society of Petroleum Engineers Inc., Richmond, TX.

(Continued)

*Primary Examiner*—Shane Bomar
(74) *Attorney, Agent, or Firm*—Trop, Pruner & Hu, P.C.; Jeremy P. Welch; Tim Curington

(57) ABSTRACT

The invention is a sealing system, such as a packer, that is used in a wellbore to seal against an exterior surface, such as a casing or open wellbore. The sealing system includes a swellable material that swells from an unexpanded state to an expanded state thereby creating a seal when the swellable material comes into contact with a triggering fluid.

24 Claims, 6 Drawing Sheets

U.S. PATENT DOCUMENTS

| | | | | |
|---|---|---|---|---|
| 3,385,367 | A | 5/1968 | Kollsman | |
| 3,918,523 | A | 11/1975 | Stuber | |
| 4,862,967 | A | 9/1989 | Harris | |
| 5,195,583 | A * | 3/1993 | Toon et al. | 166/187 |
| 5,925,879 | A * | 7/1999 | Hay | 250/227.14 |
| 6,634,431 | B2 | 10/2003 | Cook | |
| 6,719,064 | B2 | 4/2004 | Price-Smith | |
| 6,722,437 | B2 | 4/2004 | Vercaemer | |
| 6,820,690 | B2 | 11/2004 | Vercaemer | |
| 6,834,725 | B2 | 12/2004 | Whanger | |
| 6,840,325 | B2 | 1/2005 | Stephenson | |
| 6,848,505 | B2 | 2/2005 | Richard | |
| 6,854,522 | B2 | 2/2005 | Brezinski | |
| 7,357,189 | B2 * | 4/2008 | Aldaz et al. | 166/380 |
| 2003/0146003 | A1 | 8/2003 | Duggan | |
| 2004/0118572 | A1 | 6/2004 | Whanger | |
| 2004/0123983 | A1 | 7/2004 | Cook | |
| 2004/0123988 | A1 * | 7/2004 | Cook et al. | 166/379 |
| 2005/0023003 | A1 * | 2/2005 | Echols et al. | 166/384 |
| 2005/0072576 | A1 | 4/2005 | Henriksen | |
| 2005/0072579 | A1 | 4/2005 | Gambier | |
| 2005/0126776 | A1 * | 6/2005 | Russell | 166/229 |
| 2006/0124310 | A1 * | 6/2006 | Lopez de Cardenas et al. | 166/313 |
| 2006/0219406 | A1 * | 10/2006 | Boney et al. | 166/285 |

FOREIGN PATENT DOCUMENTS

| | | | |
|---|---|---|---|
| GB | 2404397 | A | 2/2005 |
| GB | 2407593 | A | 5/2005 |
| GB | 2417270 | A | 2/2006 |
| JP | 9151686 | A | 6/1997 |
| JP | 11013378 | A | 1/1999 |
| WO | WO 02/20941 | A1 | 3/2002 |
| WO | WO 02/059452 | A1 | 8/2002 |
| WO | WO 03/008756 | A1 | 1/2003 |
| WO | WO 03/056125 | A2 | 7/2003 |
| WO | WO 2004/005665 | A2 | 1/2004 |
| WO | WO 2004/005669 | A1 | 1/2004 |
| WO | WO 2004/018836 | A1 | 3/2004 |
| WO | WO 2004/022911 | A2 | 3/2004 |
| WO | WO 2004/027209 | A1 | 4/2004 |
| WO | WO 2004/057715 | A2 | 7/2004 |
| WO | WO 2004/101952 | A1 | 11/2004 |
| WO | 2004109055 | A | 12/2004 |
| WO | WO 2005/012686 | A1 | 2/2005 |
| WO | 2005090743 | A1 | 9/2005 |

OTHER PUBLICATIONS

Al-Anazi, Hamoud A., Sharma, Mukul M.; Use of a pH-Sensitive Polymer for Conformance Control; SPE International Symposium and Exhibition on Formation Damage Control; Lafayette, LA; Feb. 20-21, 2002; SPE 73782; Society of Petroleum Engineers Inc., Richmond, TX.

Al-Anazi, Hamoud A., Sharma, Mukul M.; Evaluation of a pH-Sensitive Polymer for Gravel-Packing Operations; Revised manuscript (of SPE 67292); SPE 76813 revised Jan. 2, 2002; Society of Petroleum Engineers Inc., Richmond, TX.

* cited by examiner

SYSTEM AND METHOD TO SEAL USING A SWELLABLE MATERIAL

CROSS-REFERENCE TO RELATED APPLICATIONS

This claims the benefit under 35 U.S.C. § 119(e) of U.S. Provisional Patent Application Ser. No. 60/552,567 filed Mar. 12, 2004 and of U.S. Provisional Patent Application Ser. No. 60/521,427 filed Apr. 23, 2004.

BACKGROUND

The invention generally relates to a system and method to seal using swellable materials. More specifically, the invention relates to a sealing system, such as an anchor or a packer, that includes a swellable material that swells and therefore creates a seal when the material comes into contact with a triggering fluid.

Sealing systems, such as packers or anchors, are commonly used in the oilfield. Packers, for instance, are used to seal the annulus between a tubing string and a surface exterior to the tubing string, such as a casing or an open wellbore. Commonly, packers are actuated by hydraulic pressure transmitted either through the tubing bore, annulus, or a control line. Other packers are actuated via an electric line deployed from the surface of the wellbore.

Therefore, for actuation, most packers require either enabling instrumentation disposed in the wellbore or a wellbore intervention necessary to ready the wellbore for actuation (such as the dropping of a ball to create a seal against which to pressure up the activation mechanism of the packer). However, deploying additional enabling instrumentation in the wellbore complicates the deployment of the completion system and may introduce reliability issues in the activation of the packer. Moreover, conducting an intervention to ready the wellbore for actuation adds cost to the operator, such as by increasing the rig time necessary to complete the relevant operation.

In addition, the majority of packers are constructed so that they can provide a seal in a substantially circular geometry. However, in an open wellbore (or in an uneven casing or tubing), the packer is required to seal in geometry that may not be substantially circular.

Thus, there is a continuing need to address one or more of the problems stated above.

SUMMARY

The invention is a sealing system, such as a packer, that is used in a wellbore to seal against an exterior surface, such as a casing or open wellbore. The sealing system includes a swellable material that swells from an unexpanded state to an expanded state thereby creating a seal when the swellable material comes into contact with a triggering fluid.

Advantages and other features of the invention will become apparent from the following drawing, description and claims.

DETAILED DESCRIPTION

Figure 1:
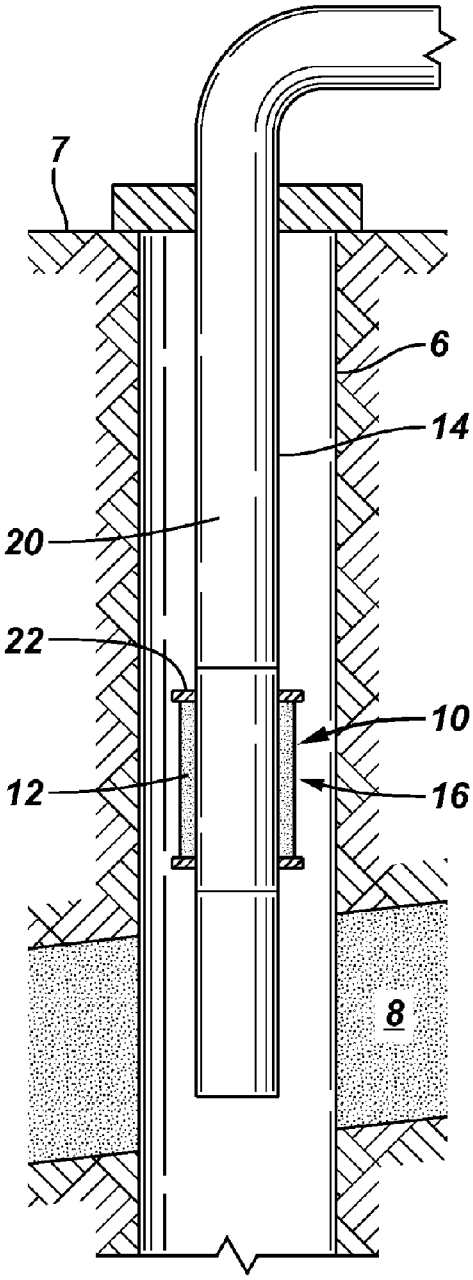
FIG. 1 is an illustration of the sealing system in an unexpanded state.
Figure 2:
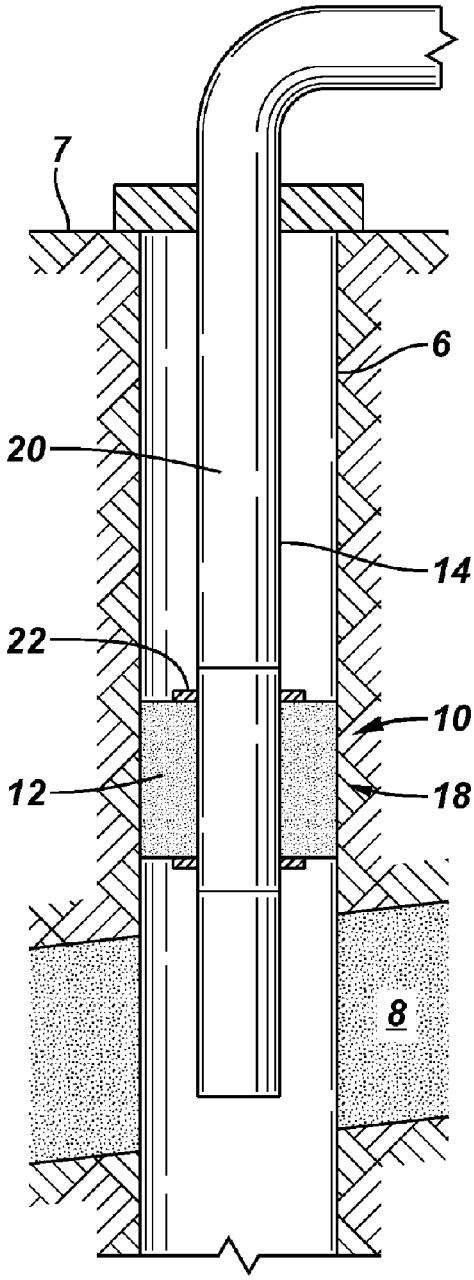
FIG. 2 is an illustration of the sealing system in an expanded state.

FIGS. 1 and 2 illustrate an embodiment of a system 10 that is the subject of this invention. System 10 is disposed in a wellbore 6 that extends from a surface 7 and intersects at least one formation 8. Formation 8 may contain hydrocarbons that are produced through the wellbore 6 to the surface 7. Alternatively, fluids, such as treating fluid or water, may be injected through the wellbore 6 and into the formation 8.

System 10 comprises a seal 12 operatively attached to a conveyance device 14. Seal 12 is constructed from a swellable material which can swell from an unexpanded state 16 as shown in FIG. 1 to an expanded state 18 as shown in FIG. 2. Swellable material swells from the unexpanded state 16 to the expanded state 18 when it comes into contact or absorbs a triggering fluid, as will be described herein. Conveyance device 14 can comprise any device, tubing or tool from which the seal 12 can shift from the unexpanded state 16 to the expanded state 18. The conveyance device 14 illustrated in the Figures is a tubing 20. Conveyance device 14 can also comprise coiled tubing or a tool deployed on a slickline or wireline.

In one embodiment, the swellable material is disposed around the tubing 20 in the unexpanded state 16. Flanges 22 are attached to the tubing 20 at either longitudinal end of the swellable material to guide the expansion of the swellable material in a radial direction.

Wellbore 6 may or may not include a casing. In the Figures shown, wellbore 6 does not include a casing. In either case, seal 12 expands to adequately seal against the wellbore or casing regardless of the shape or geometry of the wellbore or casing. For instance, if no casing is included, then the open wellbore will likely not be perfectly circular. Nevertheless, even if the open wellbore is not circular, the seal 12 expands (the swellable material swells) to adequately seal to the actual shape or geometry of the open wellbore.

The selection of the triggering fluid depends on the selection of the swellable material (and vice versa), as well as the wellbore environment and operation. Referring to Table 1 below, suitable swellable materials and their corresponding triggering fluids include the following:

TABLE 1

| Swellable Material | Triggering Fluid |
|---|---|
| ethylene-propylene-copolymer rubber hydrocarbon oil | hydrocarbon oil |
| ethylene-propylene-diene terpolymer rubber | hydrocarbon oil |
| butyl rubber | hydrocarbon oil |
| haloginated butyl rubber | hydrocarbon oil |
| brominated butyl rubber | hydrocarbon oil |
| chlorinated butyl rubber | hydrocarbon oil |
| chlorinated polyethylene | hydrocarbon oil |
| starch-polyacrylate acid graft copolymer water | water |
| polyvinyl alcohol cyclic acid anhydride graft copolymer | water |
| isobutylene maleic anhydride | water |
| acrylic acid type polymers | water |
| vinylacetate-acrylate copolymer | water |
| polyethylene oxide polymers | water |
| carboxymethyl celluclose type polymers | water |
| starch-polyacrylonitrile graft copolymers | water |
| highly swelling clay minerals (i.e. sodium bentonite) | water |
| styrene butadiene | hydrocarbon |
| ethylene propylene monomer rubber | hydrocarbon |
| natural rubber | hydrocarbon |
| ethylene propylene diene monomer rubber | hydrocarbon |
| ethylene vinyl acetate rubber | hydrocarbon |
| hydrogenised acrylonitrile-butadiene rubber | hydrocarbon |
| acrylonitrile butadiene rubber | hydrocarbon |
| isoprene rubber | hydrocarbon |
| chloroprene rubber | hydrocarbon |
| polynorbornene | hydrocarbon |

It is noted that the triggering fluid can be present naturally in the wellbore 6, can be present in the formation 8 and then produced into the wellbore 6, or can be deployed or injected into the wellbore 6 (such as from the surface 7).

Figure 5:
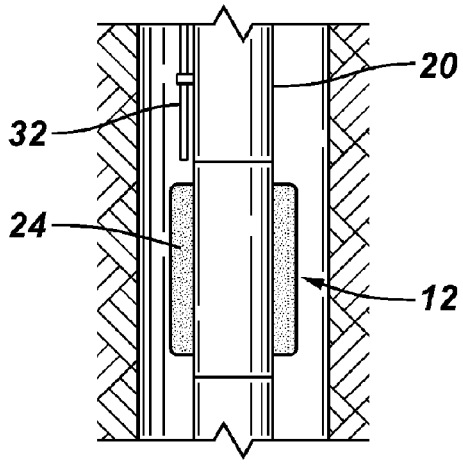
FIGS. 5-10 illustrate different techniques by which the triggering fluid can be made to contact the swellable material.
Figure 6:
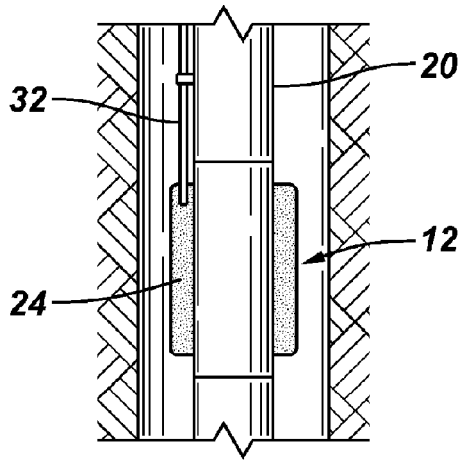
Figure 7:
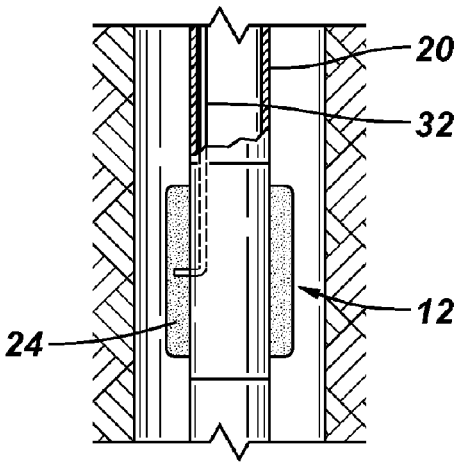
Figure 8:
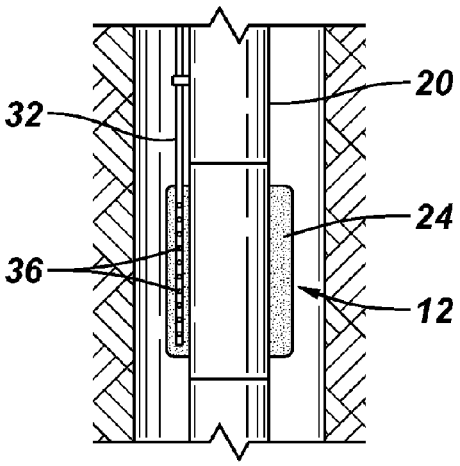
Figure 9:
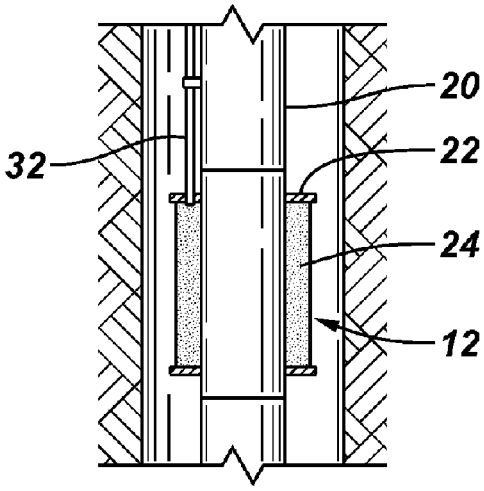
Figure 10:
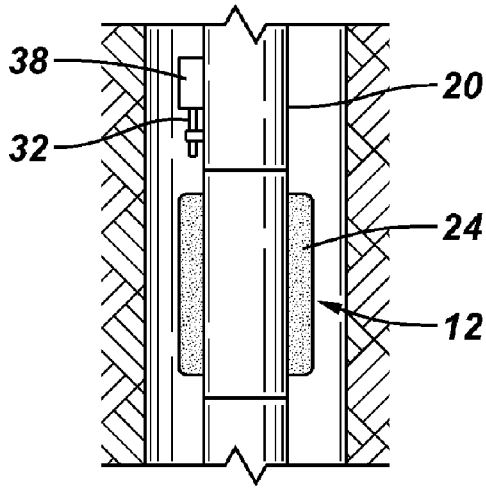

The triggering fluid can be made to contact the swellable material using a variety of different techniques. For instance, if the triggering fluid is found in the annulus (by being produced into the annulus from the formation 8, by being deployed into the annulus, or by naturally occurring in the annulus), then the triggering fluid can contact the swellable material by itself as the triggering fluid flows within the annulus proximate the seal 12. FIG. 5 shows a control line 32 that ends directly above the swellable material 24 of seal 12, wherein the triggering fluid can be supplied through the control line 32 (typically from the surface 7), into the annulus, and into contact with the swellable material 24. Similarly, FIG. 6 shows a control line 32, however the end of the control line 32 is embedded within the swellable material 24 so that the triggering fluid can be injected directly from the control line 32 and into the swellable material 24. FIG. 7 shows an embodiment wherein the control line 32 is deployed within the tubing 20 and is embedded into the swellable material 24 from the interior surface thereof. In the embodiment of FIG. 8, the control line 32 is embedded in the swellable material 24 as in FIG. 6, however the control line 32 in this embodiment continues along at least a length of the swellable material 24 and includes holes 36 to provide a more equal distribution of the triggering fluid along the length of the swellable material 24. FIG. 9 shows another embodiment similar to that of FIG. 6, except that the control line 32 is inserted through the flange 22 and not into the swellable material 24 (although the control line 32 is in fluid communication with the swellable material 24 through the flange 12). In addition and as shown in FIG. 10, any of the embodiments of FIGS. 5-9 may be utilized with a container 38 that holds the triggering fluid and that, upon an appropriate signal, releases the triggering fluid through the control line 32 and to the swellable material 24. The appropriate signal can be provided by any telemetry mechanism, such as another control line, by wireless telemetry (such as electric, electromagnetic, seismic, acoustic, or pressure pulse signals), by a timing device configured to activate after a certain time in the wellbore, by applied hydraulic pressure, or upon the occurrence of a certain condition as sensed by a sensor.

Certain of the embodiments illustrated and described, such as those in FIGS. 6, 7, 8, and 9, notably involve the contact of the triggering fluid with the swellable material in the interior (as opposed to the exterior surface) of the swellable material. Such embodiments enable an operator to better control the timing, duration, and extent of the expansion of the swellable material.

Figure 3:
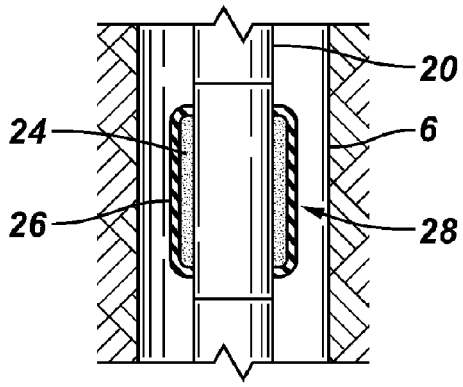
FIG. 3 shows an embodiment of the sealing system in an unexpanded state including an expandable bladder.
Figure 4:
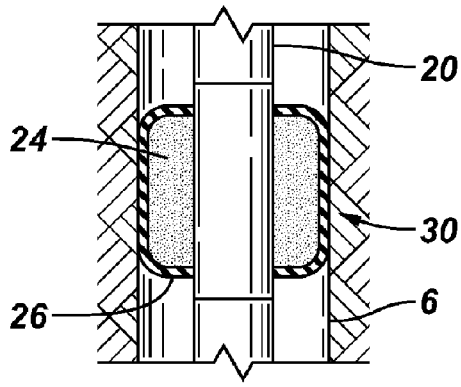
FIG. 4 is the embodiment of FIG. 3 in an expanded state.

In some embodiments, the swellable material of seal 12 is combined with other traditional sealing mechanisms to provide a sealing system. For instance, as shown in FIGS. 3 and 4, the swellable material 24 can be combined with an expandable bladder 26 (such as the bladder of an inflatable packer), wherein the swellable material 24 is located within the bladder 26. In an unexpanded state 28 as shown in FIG. 3, the bladder 26 and swellable material 24 are not expanded and do not seal against the wellbore 6. When the swellable material 24 is exposed to the appropriate triggering fluid, the swellable material 24 expands, causing the expandable bladder 26 to expand and ultimately seal against the wellbore 6 in an expanded state 30. Since the swellable material 24 tends to retain its expanded state over time, the implementation of the swellable material 24 within an expandable bladder 26 provides an open-hole sealing packer that retains its energy over time. The swellable material 24 can be exposed to the triggering fluid, such as by use of the embodiment shown in FIG. 7.

Figure 19:
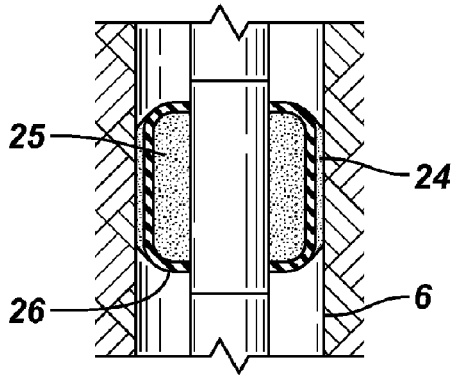
FIG. 19 shows another embodiment of the sealing system in an expanded state including an expandable bladder.

In another embodiment as shown in FIG. 19, the swellable material 24 is included on the exterior of the bladder 26. The bladder 26 is filled with the relevant filler material 25 (such as cement) as is common, and the swellable material 24 swells to take up any difference or gap between the bladder 26 and the wellbore 6.

Figure 20:
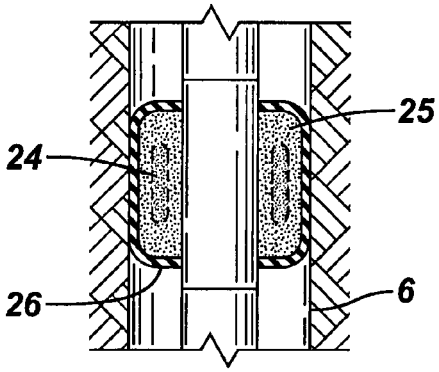
FIG. 20 shows another embodiment of the sealing system in an expanded state including an expandable bladder.

In another embodiment as shown in FIG. 20, swellable material 24 is located within the bladder 26 and dispersed with the filler material 25. If a leak through bladder 26 occurs, the swellable material 24 is activated to compensate for the leak and maintain the volume of bladder 26 constant. In this embodiment, the swellable material 24 should be selected so that it swells when in contact with the fluids that leak into bladder 26.

Figure 24:
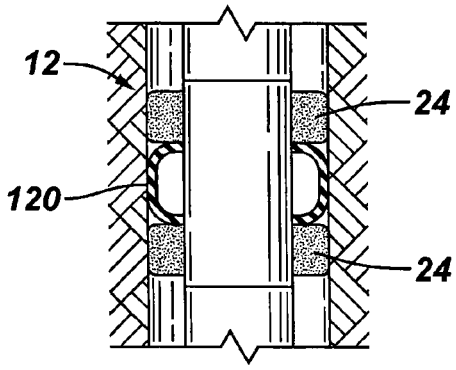
FIG. 24 depicts another embodiment of the sealing system including an inflatable bladder and swellable materials located on either end of the inflatable bladder according to an embodiment of the invention.

In another embodiment depicted in FIG. 24, a seal 12 comprised of swellable material 24 is located on either side of a prior art inflatable packer 120. The seals 12 serve as secondary seals to the inflatable packer 120 and can be activated as previously disclosed.

Figure 11:
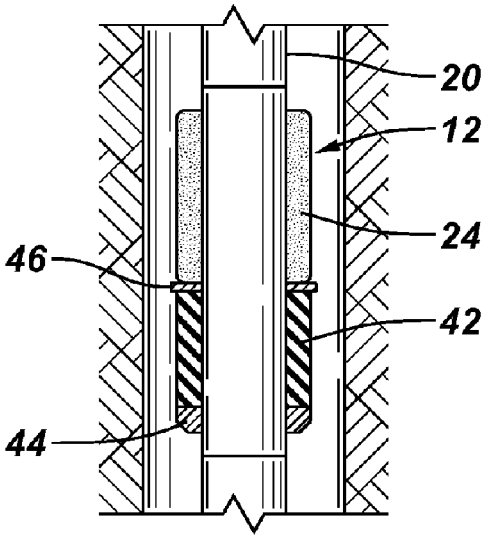
FIG. 11 shows an embodiment of the sealing system incorporating swellable material and a traditional solid rubber seal.

FIG. 11 shows a sealing system that combines the swellable material 24 of seal 12 with a traditional solid rubber seal 42 used in the oilfield. The solid rubber seal 42 can be energized by an activating piston 44 (as known in the art) so that it compresses the solid rubber seal 42 against the flange 46 expanding the solid rubber seal 42 in the radial direction.

The swellable material 24 can be swelled by exposure to the triggering fluid by one of the mechanisms previously disclosed. The use of both a swellable material seal 24 and a solid rubber seal 42 can provide an improved sealing system where the solid material adds support to the swelling material. In another embodiment (not shown), a plurality of swellable material seals 24 and solid rubber seals 42 can be alternated or deployed in series to provide the required sealing characteristics.

Figure 22:
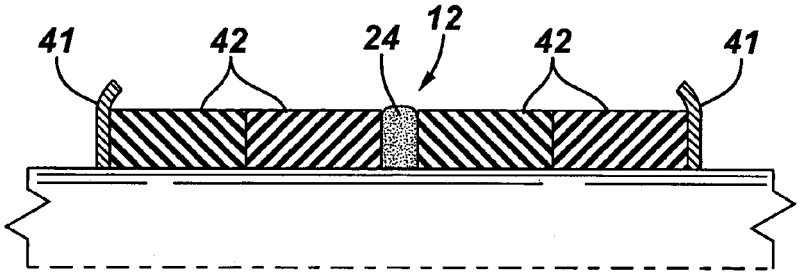
FIG. 22 shows another embodiment of the sealing system incorporating swellable material and a traditional solid rubber seal.
Figure 23:
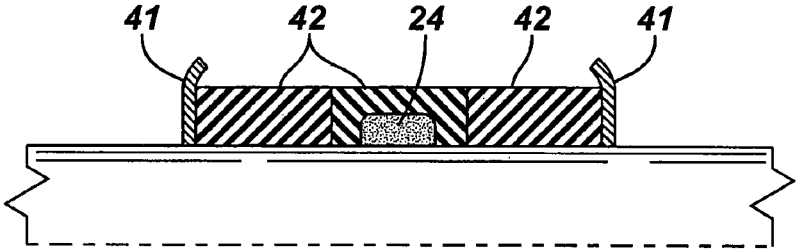
FIG. 23 shows another embodiment of the sealing system incorporating swellable material and a traditional solid rubber seal.

FIG. 22 shows a combination of a swellable material 24 seal 12 together with two rubber seals 42 on either side and anti-extrusion or end rings 41 on either side. The general configuration, minus the seal 12, is common in prior art packers. The benefit of including a seal 12 of swellable material 24 is that fluid that leaks past the rings 41 and rubber seals 42 can trigger the swellable material 24 and thus provide a back-up to the overall system. Swellable material 24 would be selected based on the fluid that could leak. FIG. 23 is similar, except that swellable material 24 is incorporated into one of the rubber seals 42.

Figure 12:
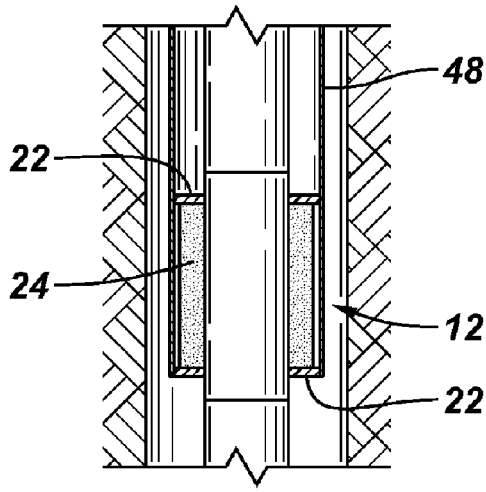
FIG. 12 shows an embodiment of the sealing system including a selectively slidable protective sleeve.

FIG. 12 shows a protective sleeve 48 covering the swellable material 24 of seal 12. This embodiment is specially useful when the triggering fluid is present in the annulus, but the operator wants to prevent the start of the swelling process until a predetermined time (such as once the seal 12 in at the correct depth). The protective sleeve 48 prevents contact between the swellable material 24 and the fluids found in the annulus of the wellbore. When the operator is ready to begin the sealing operation, the operator may cause the protective sleeve 48 to slide so as to expose the swellable material 24 to the annulus fluid which contains (or will contain) the triggering fluid. The sliding motion of the protective sleeve 48 may be triggered by a control line, by wireless telemetry (such as electric, electromagnetic, seismic, acoustic, or pressure pulse signals), by a timing device configured to activate after a certain time in the wellbore, or by applied hydraulic pressure, or upon the occurrence of a certain condition as sensed by a sensor.

Figure 13:
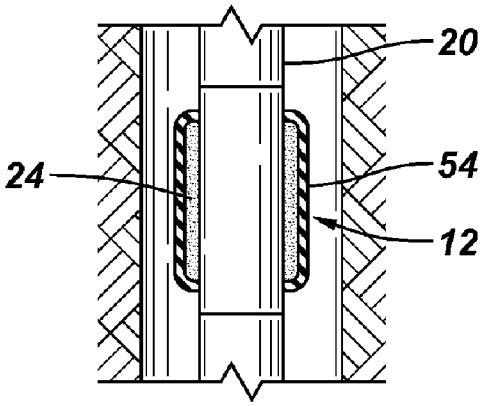
FIG. 13 shows an embodiment of the sealing system with a dissolvable coating.

FIG. 13 shows the swellable material 24 of seal 12 covered by a protective coating 54. The protective coating 54 prevents contact between the swellable material 24 and the fluids found in the annulus of the wellbore. When the operator is ready to begin the sealing operation, the operator may cause the protective coating 54 to disintegrate so as to expose the swellable material 24 to the annulus fluid which contains (or will contain) the triggering fluid. The protective coating 54 may be disintegrated by a chemical that can be introduced into the wellbore such as in the form of a pill or through a control line.

In another embodiment, protective coating 54 is a time-release coating which disintegrates or dissolves after a predetermined amount of time thereby allowing the swellable material 24 to come in contact with the triggering fluid. In another embodiment, protective coating 54 comprises a heat-shrink coating that dissipates upon an external energy or force applied to it. In another embodiment, protective coating 54 comprises a thermoplastic material such as thermoplastic tape or thermoplastic elastomer which dissipates when the surrounding temperature is raised to a certain level (such as by a heating tool). In any of the embodiments including protective coating 54, instead of disintegrating or dissolving, protective coating 54 need only become permeable to the triggering fluid thereby allowing the activation of the swelling mechanism.

Figure 21:
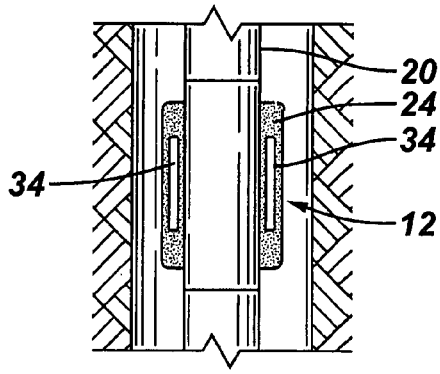
FIG. 21 shows another embodiment of the sealing system in which the triggering fluid is contained within the swellable material.

FIG. 21 shows the triggering fluid stored within the swellable material 24, such as in a container 34. When the operator is ready to begin the sealing operation, the operator may cause the container 34 to open and expose the swellable material 24 to the triggering fluid. The opening of the container 34 may be triggered by a control line, by wireless telemetry (such as electric, electromagnetic, seismic, acoustic, or pressure pulse signals), by a timing device configured to activate after a certain time in the wellbore, or by applied hydraulic pressure, upon the occurrence of a certain condition as sensed by a sensor, by the use of rupture disks in communication with the container 34 and the tubing bore or annulus, or by some type of relative movement (such as linear motion).

Figure 14:
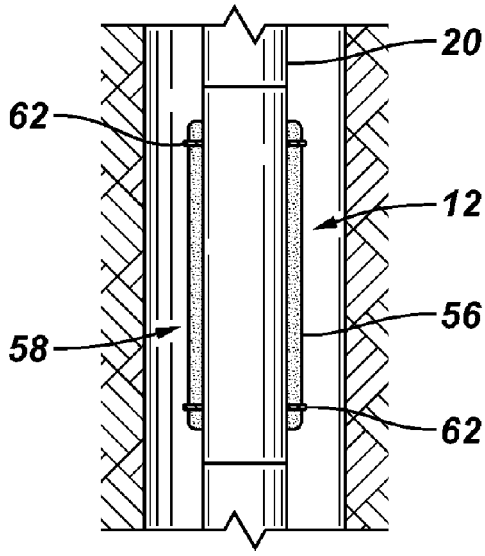
FIG. 14 shows an embodiment of the sealing system in a stretched state.
Figure 15:
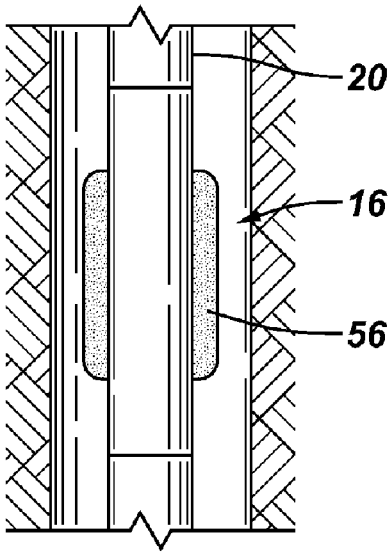
FIG. 15 shows the embodiment of FIG. 14 in the unexpanded state.
Figure 16:
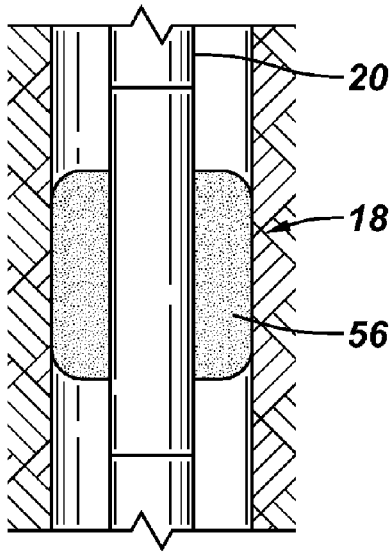
FIG. 16 shows the embodiment of FIG. 14 in the expanded state.

In another embodiment as shown in FIGS. 14-16, the swellable material 56 is stretched longitudinally prior to deployment into the wellbore. In this stretched state 58, the ends of the swellable material 56 are attached to the tubing 20 such as by pins 62. When the operator is ready to begin the sealing operation, the operator releases the pins 62 allowing the swellable material 56 to contract in the longitudinal direction to the unexpanded state 16. Next, the swellable material 56 is exposed to the relevant triggering fluid, as previously disclosed, causing the swellable material 56 to swell to the expanded state 18. The benefit of the embodiment shown in FIGS. 14-16 is that the swellable material 56 has a smaller external diameter in the stretched state 58 (than in the unexpanded state 16) allowing it to easily pass through the tubing 20 interior (and any other restrictions) while at the same time enabling a greater volume of swellable material to be incorporated into the seal 12 so as to provide a sealing system with a greater expansion ratio or with a potential to seal in a larger internal diameter thus resulting in an improved sealing action against the wellbore 6.

In some embodiments, an operator may wish to release the seal provided by the swellable material in the expanded state 18. In this case, an operator may expose the swellable material to a dissolving fluid which dissolves the swellable material and seal. The dissolving fluids may be transmitted to the swellable material by means and systems similar to those used to expose the triggering fluid to the swellable material. In fact, in the embodiment using the container 38 (see FIG. 10), the dissolving fluid can be contained in the same container 38 as the triggering fluid.

Depending on the substance used for the swellable material, the swelling of the material from the unexpanded state 16 to the expanded state 18 may be activated by a mechanism other than a triggering fluid. For instance, the swelling of the swellable material may be activated by electrical polarization, in which case the swelling can be either permanent or reversible when the polarization is removed. The activation of the swellable material by electrical polarization is specially useful in the cases when downhole electrical components, such as electrical submersible pumps, are already included in the wellbore 6. In that case, electricity can simply be routed to the swellable material when necessary. Another form of activation mechanism is activation by light, wherein the swellable material is exposed to an optical signal (transmitted via an optical fiber) that triggers the swelling of the material.

Figure 17:
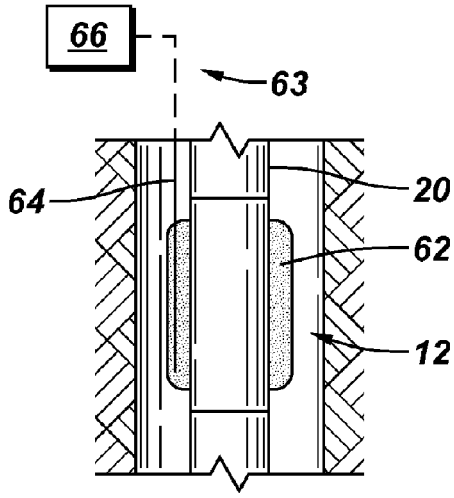
FIG. 17 shows an embodiment of the sealing system including a monitoring system.

FIG. 17 shows an embodiment of the invention in which a monitoring system 63 is used to monitor the beginning, process, and quality of the swelling and therefore sealing provided by the swellable material 62 of seal 12. Monitoring system 63 can comprise at least one sensor 64 and a control unit 66. The control unit 66 may be located at the surface 7 and receives the data from the sensor 64. The sensor 64 can be embedded within the swellable material and can be any type of sensor that senses a parameter that is in some way dependent on the swelling or swelling reaction of the swellable material. For instance, if the swelling of the swellable material is the result of an endothermic or exothermic reaction, then the sensor 64 can comprise a temperature sensor that can sense the temperature change caused by the reaction. A suitable and particularly beneficial sensor would be a distributed temperature sensor such as an optical time domain reflectometry sensor. Alternatively, the sensor 64 can be a pressure or a strain sensor that senses the changes in pressure or strain in the swellable material caused by the swelling reaction. Moreover, if the swelling activity is set to occur when a specific condition is present (such as swelling at water inflow), the fact that the swelling activity has commenced also inform an operator that the condition is present.

An operator can observe the measurements of the sensor 64 via the control unit 66. In some embodiments and based on these observations, an operator is able to control the swelling reaction such as by adding more or less triggering fluid (such as through the control lines 32 or into the annulus). In one embodiment (not shown), the control unit 66 is functionally connected to the supply chamber for the control line 32 so that the control unit 66 automatically controls the injection of the of the triggering fluid into the control line 32 based on the measurements of sensor 64 to ensure that the swelling operation is maintained within certain pre-determined parameters. The parameters may include rate of swelling, time of swelling, start point, and end point. The transmission of information from the sensor 64 to the control unit 66 can be effected by cable or wirelessly, such as by use of electromagnetic, acoustic, or pressure signals.

Figure 18:
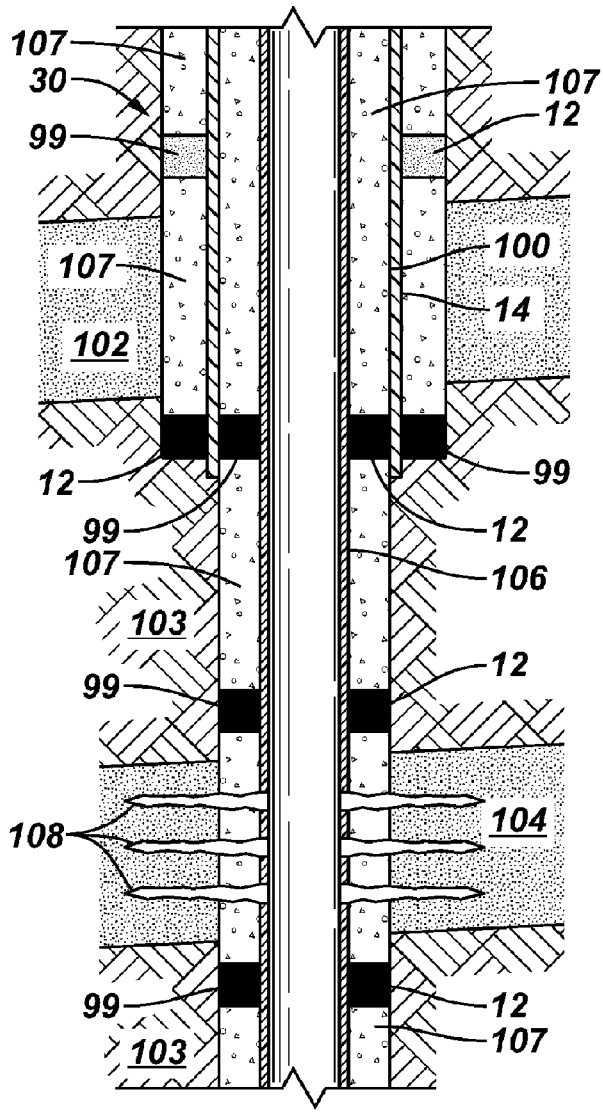
FIG. 18 shows an embodiment of the sealing system including cement disposed between seals of swellable material.

FIG. 18 shows a sealing system that includes a seal 12 of swellable material 99 and wherein the conveyance device 14 comprises a casing 100. Once triggered by the triggering fluid by one of the methods previously disclosed, the swellable material 99 expands to seal against the wellbore wall and can isolate adjacent permeable formations, such as formations 102 and 104. Impermeable zones 103 may interspace the permeable zones. Cement 107 may be injected between the seals 12 so that the casing 100 is cemented within the wellbore. The inclusion of the seal 12 of swellable material 99 ensures the isolation of the permeable zones, even if the cement 107 does not achieve this isolation or looses its capability to provide this isolation through time. For instance, the zonal isolation created by the cement 107 may be lost if mud remains at the interface between the cement and the casing and/or formation, the integrity of the cement sheath is compromised due to additional stresses produced by different downhole conditions or tectonic stresses, the cement 107 shrinks, and if well-completion operations (such as perforating and fracturing) negatively impact the cement 107. In any of these cases, the seal 12 ensures the isolation of the permeable zones.

Further, a liner or second casing 106 may be deployed within casing 100. The liner or second casing 106 may also include seals 12 of swellable material 99 that also provide the requisite seal against the open wellbore below the casing 100. The swellable material 99 may also be used to seal the liner or second casing 106 to the casing 100 wherein such a seal 12 extends between the outer surface of the liner or second casing 106 and the inner surface of the casing 100. Cement 107 may also be injected between the seals 12 sealing the liner 106 to the wellbore wall and/or between the seals 12 sealing the liner 106 to the casing 100. Additional casings or liners may also be deployed within the illustrated structure.

As shown in relation to permeable formation 104, perforations 108 may be made with perforating guns (not shown) in order to provide fluid communication between the interior of liner or second casing 106 and the permeable formation 104. Although not shown, perforations may also be made through liner or second casing 106, casing 100, and into permeable formation 102.

In addition, in the embodiment of FIG. 18, the seals 12 may be placed at the end of the casing strings in the vicinity of a casing shoe (not shown). As the majority of casings are set with the shoe in an impermeable zone, placement of the seal at these locations should prevent leakage of fluids from below into the corresponding annulus.

In other embodiments of the invention, the conveyance device 14 may comprise a solid expandable tubing, a slotted expandable tubing, an expandable sand screen, or any other type of expandable conduit. The seals of swellable material may be located on non-expanding sections between the sections of expandable conduit or may be located on the expanding sections (see US 20030089496 and US 20030075323, both commonly assigned and both hereby incorporated by reference). Also, the seals of swellable material may be used with sand screens (expandable or not) to isolate sections of screen from others, in order to provide the zonal isolation desired by an operator.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A sealing system for use in a wellbore, comprising:

an inflatable bladder disposed on a conveyance device; and a swellable material in functional association with the inflatable bladder;

wherein the swellable material swells when in contact with a triggering fluid and the inflatable bladder is adapted to be controllably expanded independently from any swelling of the swellable material in direct response to a filler material being introduced into the bladder.

2. The system of claim 1, wherein the swellable material is disposed within the inflatable bladder and wherein the swelling of the swellable material causes the expansion of the inflatable bladder.

3. The system of claim 1, wherein the swellable material is disposed on the exterior of the inflatable bladder.

4. The system of claim 3, wherein the swellable material swells to seal against the wellbore when in contact with the triggering fluid.

5. The system of claim 1, wherein the swellable material is disposed within the inflatable bladder and wherein the triggering fluid comprises fluid surrounding the inflatable bladder so that if a leak occurs in the inflatable bladder the triggering fluid comes into contact with the swellable material causing the swelling of the swellable material.

6. The system of claim 1, wherein the swellable material is located on one end of the inflatable bladder and another swellable material is located on the other end of the inflatable bladder.

7. A sealing system for use with a well, comprising:

a swellable material disposed on a conveyance device, comprising a tubular member;

a control line other than the tubular member proximate the swellable material and extending to an Earth surface of the well from which a wellbore of the well axially extends, the control line having an end near the swellable material and external to the tubular member;

wherein the swellable material swells when in contact with a triggering fluid that flows from the control line to form an annular seal between an exterior surface of the tubular member and a casing or wellbore wall.

8. The system of claim 7, wherein the control line is exterior to the swellable material.

9. The system of claim 7, wherein the control line is embedded in the swellable material.

10. The system of claim 9, wherein the control line extends along a length of the swellable material.

11. The system of claim 10, wherein the control line includes a plurality of holes to evenly distribute the triggering fluid along the length.

12. The system of claim 7, wherein the control line is embedded through an interior surface of the swellable material.

13. The system of claim 7, wherein the conveyance device comprises a tubing and the control line is disposed within the tubing.

14. The system of claim 7, wherein flanges are disposed at each end of the swellable material and wherein the control line is disposed through an upper flange.

15. The system of claim 7, wherein the control line extends from a downhole container.

16. A sealing system for use in a well, comprising:

a swellable material disposed on a conveyance device;

wherein the swellable material swells when in contact with a triggering fluid to contact a wellbore wall or a casing to form a first annular barrier in the well; and wherein cement is disposed in the well to contact the wellbore wall or the casing to form a second annular barrier adjacent to the first annular barrier.

17. The sealing system of claim 16, wherein the conveyance device comprises a casing and the swellable material swells to contact a wellbore wall.

18. The sealing system of claim 16, wherein the conveyance device comprises a liner and the swellable material swells to contact a wellbore wall.

19. The sealing system of claim 16, wherein the swellable material is disposed at two locations on the conveyance device and the cement is disposed between the two locations.

20. The sealing system of claim 16, wherein the swellable material isolates a permeable formation from an impermeable formation.

21. A method for sealing for use in a wellbore, comprising:

deploying a swellable material on a conveyance device in the wellbore;

exposing the swellable material to a triggering fluid to cause the swelling of the swellable material;

monitoring the swelling process of the swellable material, comprising monitoring a temperature of the swellable material; and using the results of the monitoring of the temperature to determine whether swelling of the swellable material has been initiated.

22. The method of claim 21, wherein the monitoring step comprises deploying at least one sensor in proximity to the swellable material.

23. The method of claim 22, wherein the deploying step comprises embedding the sensor in the swellable material.

24. The sealing system of claim 16, wherein the cement is introduced into the wellbore from the surface of the well.

* * * * *